US009929503B2

(12) United States Patent
Gunreben et al.

(10) Patent No.: US 9,929,503 B2
(45) **Date of Patent: *Mar. 27, 2018**

(54) AIRBAG CONNECTOR SYSTEM

(71) Applicant: Delphi International Operations Luxembourg, S.A.R.L., Bascharage (LU)

(72) Inventors: Michael Gunreben, Schwanstetten (DE); Vincent Regnier, Spardorf (DE); Thomas Schmidt, Nuremberg (DE)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 15/497,666

(22) Filed: Apr. 26, 2017

(65) Prior Publication Data

US 2017/0237200 A1 Aug. 17, 2017

Related U.S. Application Data

(63) Continuation of application No. 15/266,284, filed on Sep. 15, 2016, which is a continuation of application (Continued)

(30) Foreign Application Priority Data

Oct. 20, 2011 (WO) ..... PCT/IB2011/002906

(51) Int. Cl.
*H01R 13/627* (2006.01)
*H01R 13/639* (2006.01)
*H01R 13/641* (2006.01)

(52) U.S. Cl.
CPC ..... *H01R 13/6273* (2013.01); *H01R 13/639* (2013.01); *H01R 13/641* (2013.01); *H01R 2201/26* (2013.01)

(58) Field of Classification Search
CPC ..... H01R 13/627; H01R 29/00
(Continued)

(56) References Cited

U.S. PATENT DOCUMENTS 5,036,768 A * 8/1991 Dow ..... F42B 3/188 102/202.2
6,544,060 B2 * 4/2003 Wakui ..... B60R 21/017 439/188

(Continued)

*Primary Examiner* — Abdullah Riyami
*Assistant Examiner* — Nader Alhawamdeh
(74) *Attorney, Agent, or Firm* — Robert J. Myers

(57) ABSTRACT

The present invention provides an airbag connector system comprising an airbag squib connector adapted to be mated with a corresponding airbag squib socket, whereby the airbag squib connector comprises a connector housing with a connection tube. The connection tube is provided with at least one reversed locking arm adapted to lock the airbag squib connector to the airbag squib socket, whereby the reversed locking arm extends from a flexible torsion element provided at an insertion sided end of the connection tube in a direction essentially opposing the insertion direction of the airbag squib connector into the corresponding socket. Thereby, the flexible torsion element is adapted to deform and thereby enable a deflection of the reversed locking arm upon insertion of the airbag squib connector into the airbag squib socket.

17 Claims, 7 Drawing Sheets

Related U.S. Application Data

No. 14/352,072, filed as application No. PCT/EP2012/070093 on Oct. 10, 2012, now abandoned.

(58) Field of Classification Search
USPC ..... 439/354
See application file for complete search history.

(56) References Cited

U.S. PATENT DOCUMENTS

| | | | | |
|---|---|---|---|---|
| 7,108,540 | B2 * | 9/2006 | Annecke | H01R 13/6275 439/352 |
| 7,147,503 | B2 * | 12/2006 | Shindo | H01R 13/6277 439/354 |
| 7,344,403 | B2 * | 3/2008 | Major | H01R 13/6271 439/352 |
| 7,670,164 | B2 * | 3/2010 | Shiga | H01R 13/506 439/278 |
| 2002/0081888 | A1 * | 6/2002 | Regnier | H01R 13/639 439/352 |
| 2002/0154494 | A1 * | 10/2002 | Nagamine | H01R 13/7032 361/816 |
| 2004/0192099 | A1 * | 9/2004 | Seminara | H01R 13/639 439/352 |
| 2005/0020136 | A1 * | 1/2005 | Johannes | H01R 13/7197 439/620.07 |
| 2012/0112762 | A1 * | 5/2012 | Odorfer | F42B 3/26 324/538 |

* cited by examiner

AIRBAG CONNECTOR SYSTEM

CROSS-REFERENCE TO RELATED APPLICATION

This application is a continuation application and claims benefit under 35 U.S.C. § 120 to U.S. patent application Ser. No. 15/266,284, filed Sep. 15, 2016, which is a continuation application that claims benefit under 35 U.S.C. § 120 to U.S. patent application Ser. No. 14/352,072, filed Apr. 16, 2014, which is a national stage application under 35 U.S.C. § 371 of PCT Application Number PCT/EP2012/070093 having an international filing date of Oct. 10, 2012, which designated the United States, said PCT application claiming the benefit of PCT Application Number PCT/IB2011/002906, having an international filing date of Oct. 20, 2011, which also designated the United States, the entire disclosure of each of which are hereby incorporated herein by reference.

TECHNICAL FIELD OF THE INVENTION

The present invention relates to a scoop-proof electrical connector system, in particular for pyrotechnical safety restraint (SRS) systems, as e.g. airbag connector systems comprising an electrical connector adapted to be connected to a corresponding socket by means of reversed locking arms.

BACKGROUND OF THE INVENTION

To protect contact pins in particular of SRS connectors as for example airbag squib connectors upon mating to corresponding sockets, so called "scoop-proof" connector systems exist. Such systems typically consist of a squib connector with a connection tube being shaped as a closely fitting counterpart of a corresponding squib socket. Due to the corresponding closely fitting shapes of connection tube and socket, the squib connector can be inserted into the socket only at a correct angle and thus, damage of contact pins of the socket due to false insertion of the connector is prevented. To further protect the pins, the system can be provided with a retainer which is inserted into the socket before the connector is mated. The retainer usually is shaped to cover the contact pins of the socket, being essentially shaped as an inner counterpart of the connection tube and thereby further ensuring the correct mating of squib connector and squib socket.

An example of a scoop-proof airbag connector is disclosed in document DE 202 16 337 U1. Therein, a squib connector is described which can be connected to a squib socket by means of reversed locking arms. Such reversed locking arms usually extend from an insertion sided end of a connection tube of the squib connector in a direction opposing the insertion direction of the squib connector into the socket. Upon mating of the squib connector to the squib socket, these locking arms are deflected inwardly until locking steps provided thereon snap into a corresponding groove of the socket. According to DE'337, the connection tube and the reversed locking arms are made from a conductive material such as metal to prevent electrical discharges upon mating.

A further example of a scoop-proof electrical connector is disclosed in document EP 2 230 731 A1. The squib connector disclosed therein can be connected to a corresponding squib socket by means of locking arms which are pivotably mounted to flexible portions provided on a connection tube of the squib connector. Due to the flexibility of this portion, upon insertion of the squib connector into the socket, the locking arms pivot inwardly until locking projections provided thereon snap into corresponding recesses.

Document WO 2008/048541 A2 describes a further example of a squib connector which can be mounted to a corresponding socket by means of reversed locking arms. The reversed locking arms described therein are mounted to steps extending in rectangular direction outwards from sidewalls of a connection tube of the squib connector. Similar as in the cases described above, upon insertion of the squib connector into a corresponding socket, the locking arms bend inwardly until locking projections of the locking arms snap into a corresponding groove of the socket to fix the squib connector to the socket.

BRIEF SUMMARY OF THE INVENTION

It is an object of the present invention to improve the state of the art by providing an electrical connector system, in particular for SRS systems, with a connector with improved reversed locking arms which can be fabricated from injection-molded plastic material. It is a further object of the present invention to provide a connector for an electrical connector system, in particular for SRS systems, which facilitates assembly of the connector with a corresponding socket. These and other objects which become apparent upon reading the following description are solved by the electrical connector system.

According to the invention, an electrical connector system, in particular for pyrotechnical safety restraint systems such as airbag connector systems, is provided which comprises an electrical connector which is adapted to be mated with a corresponding socket, whereby the electrical connector comprises a connector housing with a connection tube. To lock the electrical connector to the socket, the connection tube is provided with at least one reversed locking arm.

Preferably, the reversed locking arm is integrally formed with the connector housing and preferably is not made from metal but most preferably from a nonconductive material, e.g. plastic. Thus, preferably the electrical connector can be produced as an inexpensive injection-molded plastic piece. The electrical connector can be connected indirectly to the socket, i.e. the reversed locking arm can interact with an intermediate component such as with an airbag squib retainer which is locked to the socket. However, most preferably the reversed locking arm is adapted to lock the electrical connector directly to the socket.

According to the invention, the reversed locking arm extends from a flexible deformable element which is provided at the insertion sided end of the connection tube, whereby the flexible deformable element is adapted to deform, thereby enabling a deflection of the reversed locking arm upon insertion of the electrical connector into the socket. In this document "deformable" means which is able to deform. Thus, as opposed to the case of a metal locking arm extending from a stiff, rigid metal tube, the inventive reversed locking arm extends from a flexible portion of the connection tube, i.e. from the flexible deformable element. Due to this inventive construction, the reversed locking arm is provided with advantageous flexibility, thereby preventing degrading effects based e.g. on material fatigue. Preferably, in fully mated condition, the reversed locking arm is not biased against any component of the system, whereby the prevention of effects based on material fatigue is further enhanced.

In a preferred embodiment, the reversed locking arm is provided with a locking protrusion extending outwardly from the reversed locking arm having a non-symmetric essentially trapezoidal cross section. Thereby a self-locking function of the electrical connector is enabled, i.e. the locking protrusion of the locking arm is designed such that when the connector is fully mated with the socket and a force is applied to the electrical connector in a direction opposing the insertion direction, and the locking action of the locking protrusion intensifies, thereby acting against the force.

In a preferred embodiment, the electrical connector system further comprises an airbag squib retainer which is adapted to be inserted into the socket and which is adapted to receive the electrical connector whereby the airbag squib retainer is provided with a locking tongue to lock the airbag squib retainer to the socket. The squib retainer can for example be provided to enable a scoop-proof function to protect contact pins of the socket as described in the introduction.

Preferably, the airbag squib retainer has an essentially cylindrical shape and is provided with an essentially cylindrical base portion with at least one cut-out. Thereby, the overall height of the retainer and the height of the retainer cut-out are dimensioned to facilitate a deflection of the reverse locking arm during mating of the system. Preferably, the ratio $h_{retainer}/h_{cut\text{-}out}$ of the retainer height $h_{retainer}$ with respect to the height of the cut-out $h_{cut\text{-}out}$ is less than 3, preferably less than 2, more preferably less than 1.75, and most preferably less than 1.1. The inventors found that by correctly choosing this ratio, optimal flexibility of the reversed locking arm is achieved. In a preferred embodiment, the ratio $h_{retainer}/h_{cut\text{-}out}$ equals 1, i.e. the cut-out portion is cut out along the entire height of the retainer.

Even though due to the inventive reversed locking arms, the electrical connector can be firmly mated with the socket such that additional security members are not necessary, in a most preferred embodiment the electrical connector system further comprises a secondary locking device which is assigned to the connector housing and which is movable between an open and a closed position. The secondary locking device is provided with a locking surface which is adapted to abut a corresponding blocking surface of the reversed locking arm when the secondary locking device is placed in the closed position whereby an inward deflection of the reversed locking arm is prevented.

Thereby, the reversed locking arm is blocked in locking engagement with the socket such that in order to unmate the electrical connector from the socket, first the secondary locking device has to be removed. Further, the secondary locking device can only be placed into its closed position when the electrical connector is inserted into the socket. Thus, an operator can visually detect the mated state of electrical connector and socket. In a preferred embodiment, the electrical connector system is not provided with electrical shorting members such as shorting bridges which short circuit for example electrical contact pins of the socket when the connectors are not fully mated.

Generally preferred, the connector housing is made from injection molded plastics. As material for the connector housing preferentially Polyamide (PA) is used, as e.g. PA 6 and/or PA 6,6 and even more preferentially polyamide comprising glass fibers as reinforcement is used. PBT can also be used.

In a preferred embodiment, the connector housing comprises one or more ferrite choke(s) adapted to reduce electromagnetic inferences.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
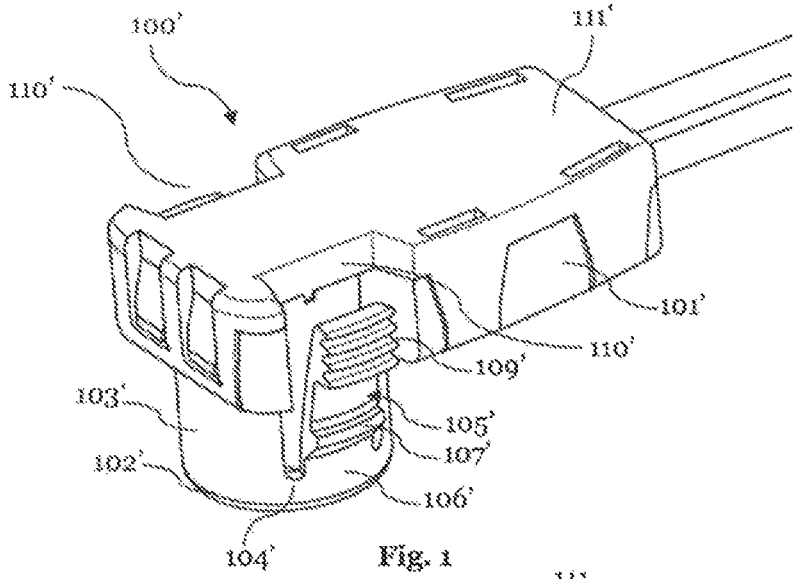
FIG. 1 shows a schematic illustration of an electrical connector to be used in connection with an airbag connector system.

FIG. 1 shows an electrical connector 100' to be used in connection with an airbag connector system. As one can see, the electrical connector 100' is provided with a connector housing 101' which is closed by a lid 111'. The connector housing 101' is provided with a connection tube 103' which extends in essentially perpendicular orientation from the connector housing 101'. As it will be clear to the skilled person, likewise different orientations of the connection tube are possible.

As one can see in FIG. 1, the connection tube 103' is provided with a reversed locking arm 105' which is formed integrally with the connection tube 103'. A similar reversed locking arm 105' is provided on the opposing side of the connection tube 103' which is not visible in FIG. 1 due to the perspective. Two locking arms 105' are advantageous; however one or more than two locking arms 105' are possible. The reversed locking arm 105' extends from a flexible deformable element 106' which is provided within a lower half of the connection tube 103'. As shown in the figures, and as it is generally preferred, the connector housing 101' comprises two cut-outs 110' adjacent the locking arms 105', which are arranged to facilitate the actuation of the arms. Preferably, the flexible deformable element is provided within a lower third, more preferably within a lower quarter and most preferably as shown at the insertion sided end on the lower edge 104' of the connection tube. The reversed locking arm 105' is provided with a non-symmetric, essentially trapezoidal locking protrusion 107' which extends outwardly from the reversed locking arm away from the connection tube 103'. The locking protrusion 107' is adapted to snap for example into a locking recess of a corresponding socket to lock the electrical connector 100' to the socket.

Due to the above described self-locking function provided by the reversed locking arms 105', the electrical connector 100' can be firmly connected to a corresponding socket such that extra security mechanisms such as secondary locking devices are not required. In order to release the electrical connector 100' from the mated state in the socket, an operator has to press grooved section 109' of the reversed locking arm 105' to bend the reversed locking arm 105' inwardly, thereby releasing the locking protrusion 107' from the groove.

Figure 2:
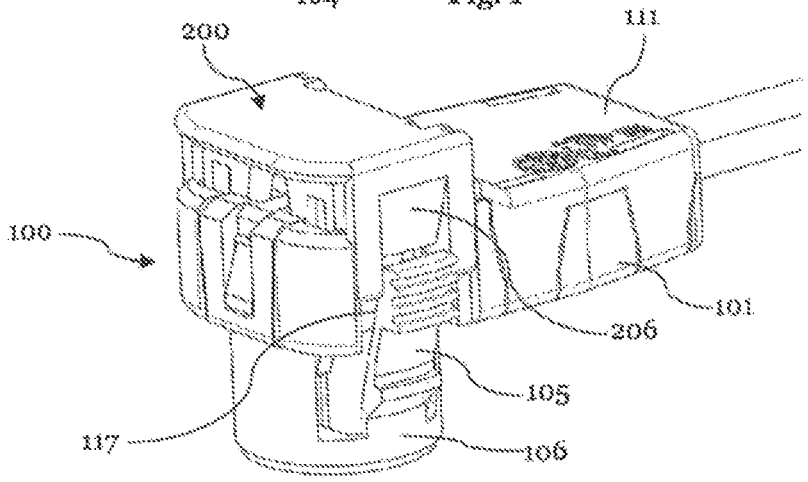
FIG. 2 shows a different embodiment of an electrical connector which is provided with a secondary locking device.

Even though secondary locking devices are not strictly necessary, such devices can be provided for additional security. FIG. 2 shows a further embodiment of the electrical connector 100 which is provided with a secondary locking device 200 and is apart from that identical to the embodiment of FIG. 1 (identical components have the same number differentiated by an apostrophe; i.e. 111' denotes the same part in the FIG. 1 embodiment as 111 in the FIG. 2 embodiment). As can be derived from FIG. 2, the secondary locking device 200 is provided with a locking surface 206 which moves behind a blocking surface 117 of the reversed locking arm 105 when the secondary locking device is moved into the electrical connector 100, i.e. into a closed position. As can be derived from FIG. 2, when the secondary locking device 200 is placed in the closed position the locking surface 206 prevents a deflection of the reversed locking arm 105 inwardly, i.e. towards the connector housing 101. Thus, when the electrical connector 100 is mated with the socket and the secondary locking device is placed in the closed position, unmating of the squib connector with the socket is prevented.

Figure 3:
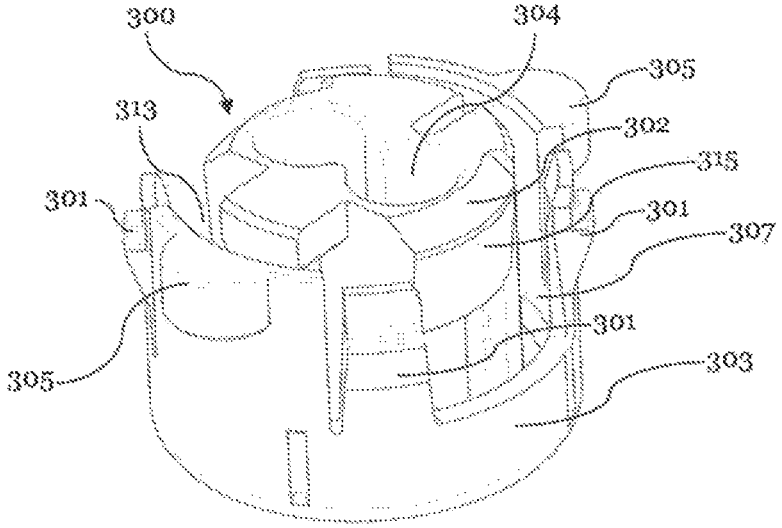
FIG. 3 shows a schematic illustration of an airbag squib retainer.

FIG. 3 shows a schematic illustration of an airbag squib retainer 300. The airbag squib retainer 300 is adapted to be inserted into a socket and is provided with four locking tongues 301 to be fixed in corresponding recesses provided in the socket. As it will be clear to the skilled person, likewise, more or less locking tongues 301 are possible if desired. The airbag squib retainer 300 is further adapted to receive the electrical connector 100, i.e. the airbag squib retainer is provided with an essentially circular-shaped recess 313 which can receive the connection tube 103 of the electrical connector 100, 100'. The retainer is further provided with a scoop-proof protection dome 315 which in mounted condition surrounds contact pins of the socket. As can be derived from FIG. 3, due to this scoop-proof connection dome, the connection tube 103 has a ring-shaped end, surrounding the dome when the connector and the retainer are mated. Thanks to the scoop-proof connection dome, it is not possible to insert the connection tube 103 of the electrical connector 100 at a false angle, whereby the electrical contact pins are protected against damage.

Figure 4:
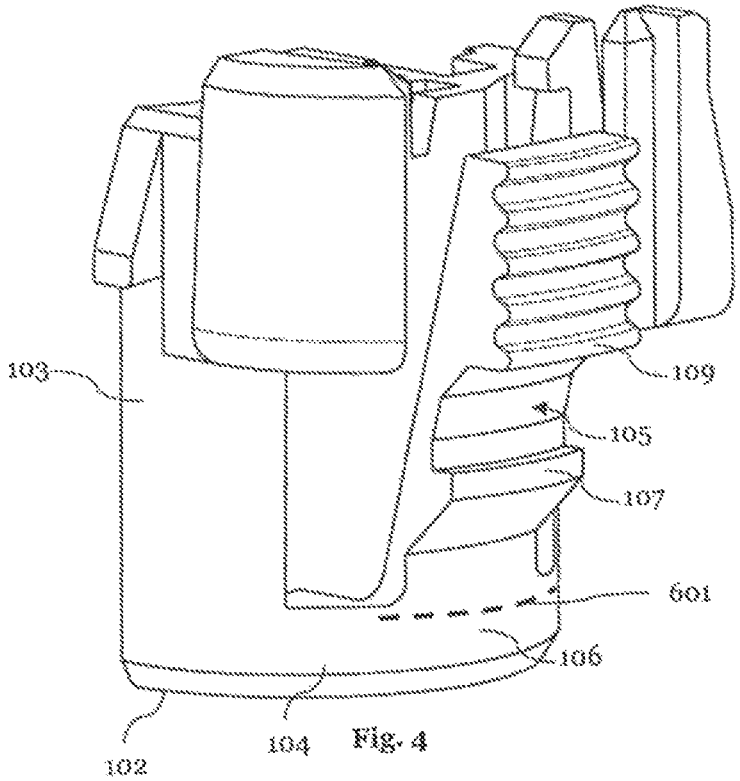
FIG. 4 shows a detail illustration of part of the connection tube with the reversed locking arm.

FIG. 4 shows a detail view of the connection tube 103 of the electrical connector 100. As one can see, the flexible deformable element 106 is formed as an integral part of a base ring 104 provided at the insertion sided end 102 of the connection tube 103. Likewise, the flexible deformable element can be formed as an integral portion of the connection tube 103. Upon deflection of the reversed locking arm 105, the flexible deformable element 106 performs a torsion movement essentially around a circumferential line which is indicated by the dashed black line 601 in FIG. 4. Further, as it will be clear to the skilled person, upon the deflection of the locking arm the flexible deformable element 106 itself may also be moved inwardly towards the center of the connection tube 103, thereby deforming the ring shape of the base ring 104.

Figure 5A:
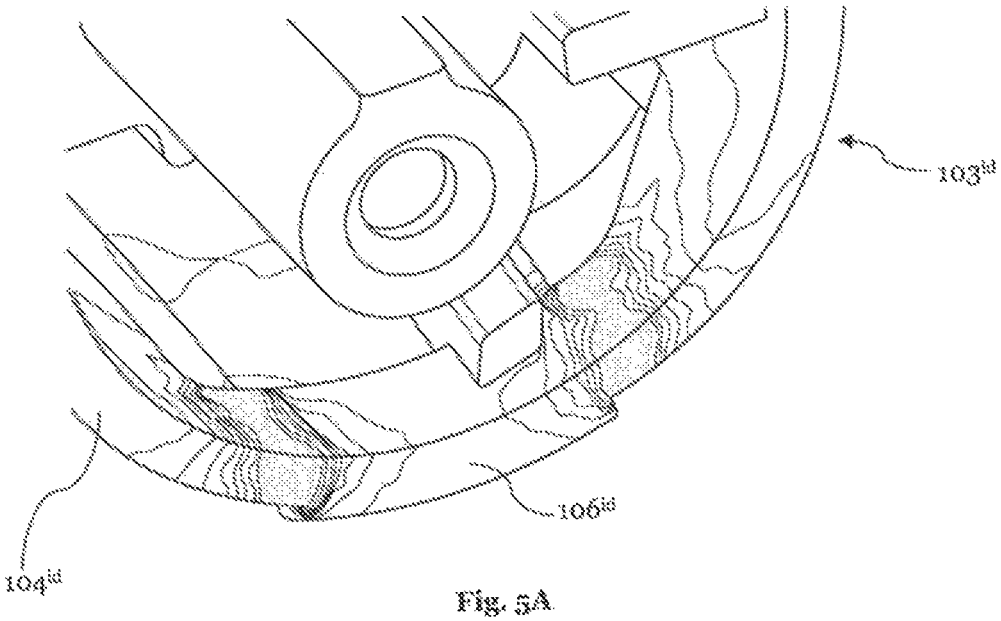
FIG. 5A illustrates a simulation of an inwardly directed bending of an embodiment of a reversed locking arm according to an intermediate development.

FIG. 5A illustrates the result of a simulation of an inwardly directed bending of a reversed locking arm 105$^{id}$ according to an embodiment of the invention corresponding to an intermediate development. This intermediate development was achieved by the inventors of the present invention by providing improved reversed locking arms to a base ring of a standard connector. As one may derive from the illustration, the lines around the base ring 104$^{id}$ show different regions of different strain or total deformation of the material, whereby the density of the lines indicates the magnitude of the total deformation. The grey shaded areas indicate the zones of maximum total deformation and strain. As can be derived from FIG. 5A, even though this design allows for satisfactory results, upon bending the locking arm, areas of a corresponding base ring 104$^{id}$ adjacent to the reversed locking arm 105' are subjected to a relatively large strain which in certain cases may exceed a maximum strain allowed by the material.

Figure 5B:
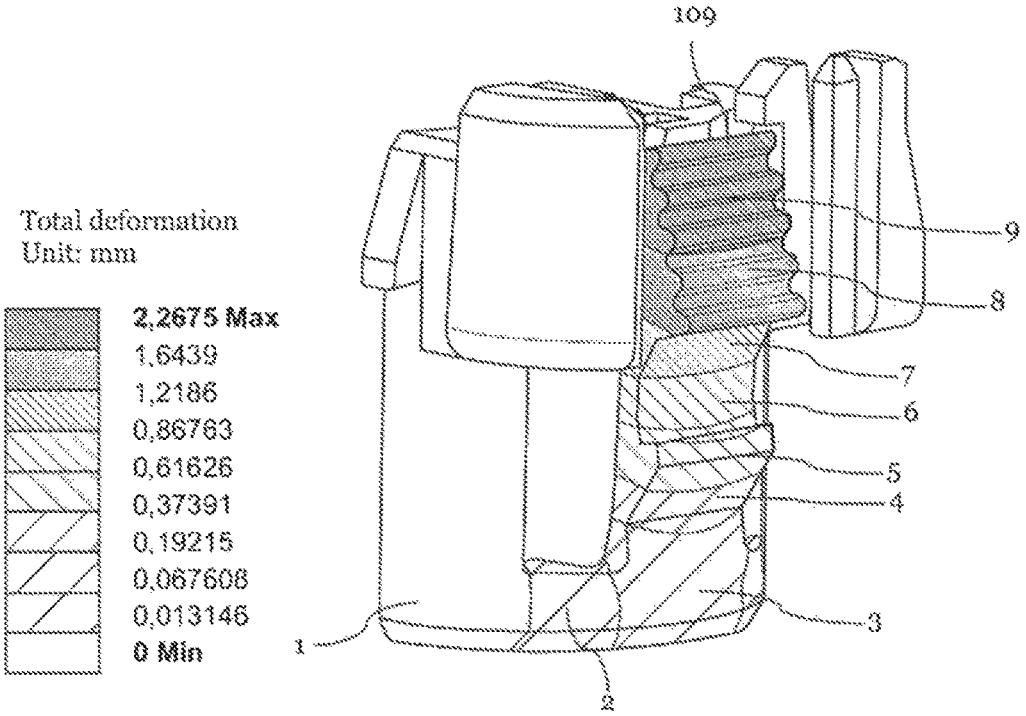
FIG. 5B illustrates a further simulation, whereby a further embodiment of a reversed locking arm is shown bent inwardly.

FIG. 5B shows the result of a simulation of an inward bending action of a reversed locking arm 105, illustrating the total deformation of the flexible deformable element 106. As can be derived from the scale provided in FIG. 5B, the differently shaded sections 1 to 9 are sections of different magnitude of total deformation. Thereby, section 1 corresponding essentially to the main part of the connection tube 103 is not deformed at all. The upper part of the groove portion 109 corresponds to the area of maximum deformation denoted as section 9. As can be derived from the scale provided in FIG. 5B, this area is moved inwardly by about 2.3 mm. In FIG. 5B the flexible deformable element 106 corresponds essentially to section 3.

As can be further derived from FIG. 5B, the deflection gradually decreases from section 9 towards section 2 whereby section 2 corresponds to two portions of the base ring 104 which are only deformed by about 0.01 mm. In other words, in contrast to the intermediate development shown in FIG. 5A, the base ring zones adjacent to the inventive flexible deformable element 106 are barely subject to any deformation.

This is due to a deformation of the flexible deformable element 106, corresponding to section 3 which is deformed by up to about 0.2 mm, i.e. an upper portion of the flexible deformable element is moved inwardly while a lower portion may be moved slightly outwardly. Thereby, the flexible deformable element provides advantageous flexibility to the reversed locking arm 105. Due to this advantageous flexibility provided by the inventive combination of reversed locking arm 105 with the flexible deformable element 106 it becomes possible to provide a reliable reversed locking arm which is producible by inexpensive plastic material. Further due to this construction damages based on material fatigue are diminished as compared to prior art plastic constructions.

Figure 6:
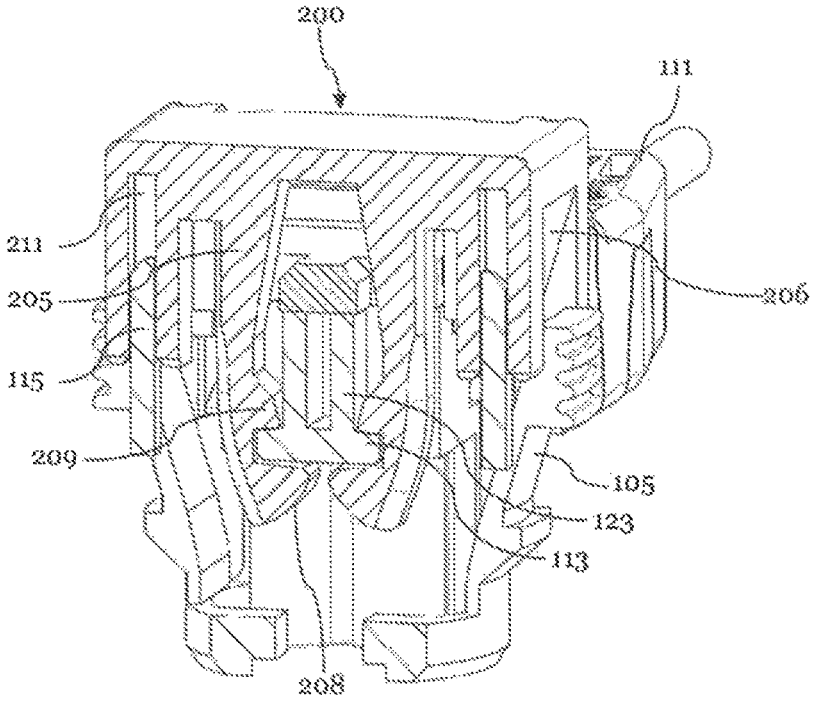
FIG. 6 shows a cross-sectional view of the electrical connector of FIG. 2, whereby the secondary locking device is placed in the open position.

FIG. 6 shows a cross-sectional view of the electrical connector 100 of FIG. 2 whereby the secondary locking device 200 is placed in an open position. As can be seen in FIG. 6, upon moving the secondary locking device 200 into the connector housing 101, the secondary locking device is guided by guide walls 115 which are moved into guiding slots 211 of the secondary locking device 200. In FIG. 6, the secondary locking device 200 is placed in its open position, wherein it is held by an interaction of holding arms 205 with a support structure 123 of the connector housing 101. In the open position stop projections 209 of the holding arms 205 rest on stop protrusions 113 of the support structure 123, whereby a downward movement of the secondary locking device 200 into the connector housing 101 is prevented. To release the secondary locking device 200 from its open position, an interaction of the holding arms 205 with release surfaces 302 of the airbag squib retainer (cf. FIG. 3) is necessary. Upon insertion of the electrical connector 100 into the airbag squib retainer 300, a deflection surface 208 at the lower end of the holding arm 205 engages a release surface 302 of the airbag squib retainer 300 (cf. FIG. 3). Due to the interaction of the deflection surface 208 with the release surface 302, the holding arms 205 are deflected outwardly and the stop projections 209 are released from the stop protrusions of the connector housing 101. Thus, the secondary locking device 200 is released and can be moved in insertion direction, i.e. along arrow 600, into the fully mated condition as shown in FIG. 7.

Figure 7:
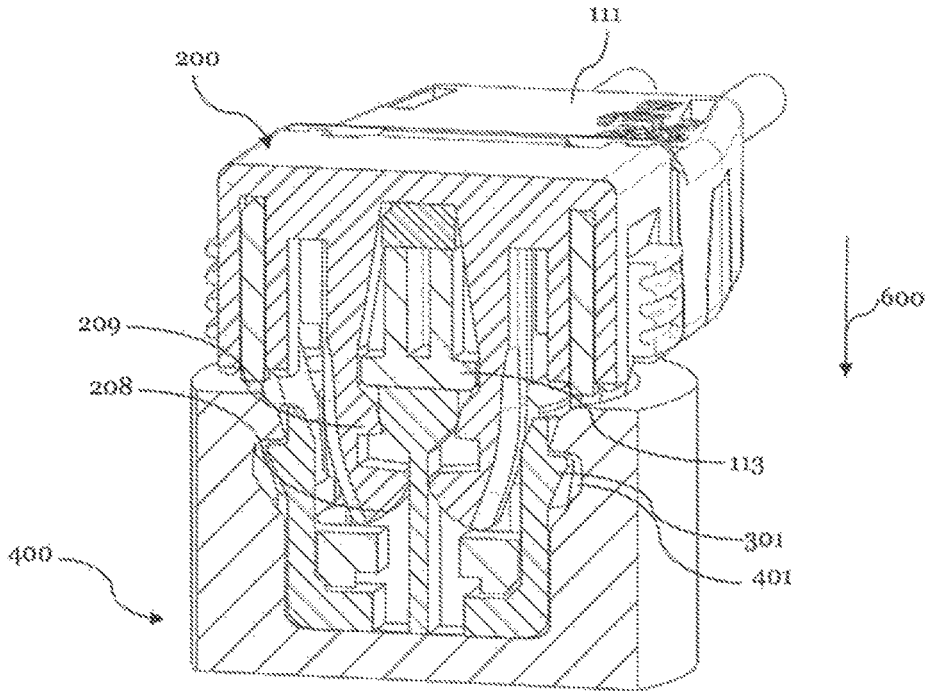
FIG. 7 shows a cross-sectional view of the squib connector of FIG. 2 whereby the secondary locking device is placed in the closed position.

FIG. 7 shows the fully mated condition of the electrical connector 100 with a corresponding socket 400. As can be seen in FIG. 7, the airbag squib retainer is placed inside the socket 400 and locking tongues 301 are placed in a locking groove 401 of the socket to fix the airbag squib retainer inside the socket. Similarly, the locking protrusions 107 of the reversed locking arms 105 are placed inside the same locking groove 401 (not visible due to the perspective of FIG. 7) to lock the electrical connector 100 directly to the socket 400.

Figure 8:
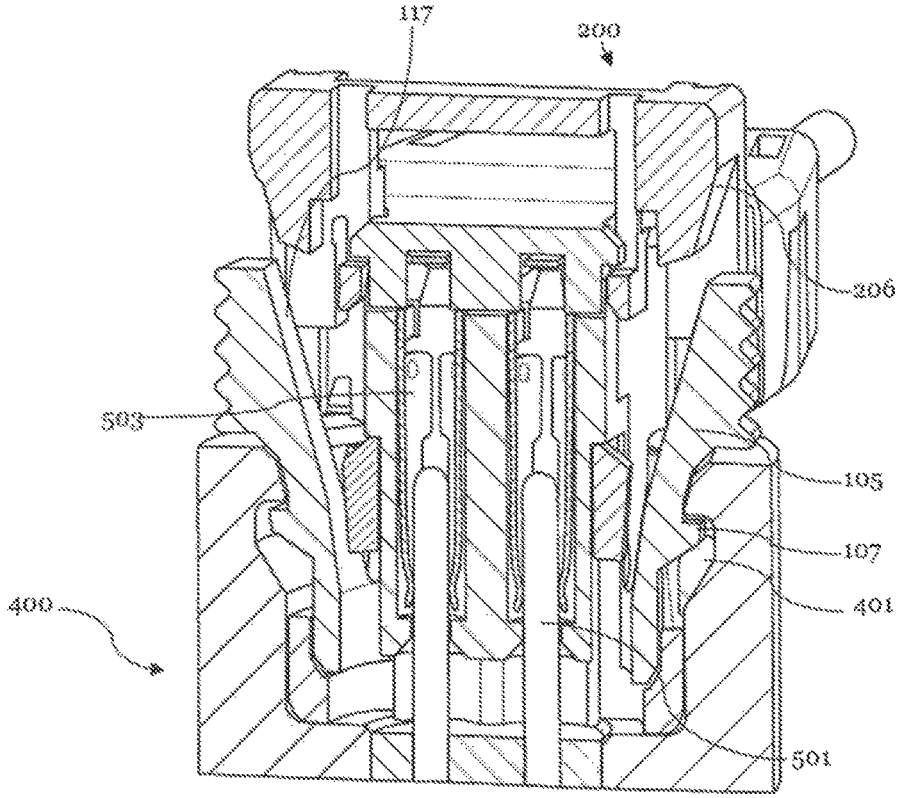
FIG. 8 shows a different cross-sectional view of the electrical connector of FIG. 2 with the secondary locking device being placed in the open position.

FIG. 8 shows a different cross section of the airbag connector system with the secondary locking device 200 placed in the open position. As can be seen in FIG. 8, the electrical connector 100 is already fully mounted with the socket 400 and the locking protrusions 107 of the reversed locking arms 105 are placed in the locking groove 401 of the socket.

Figure 9:
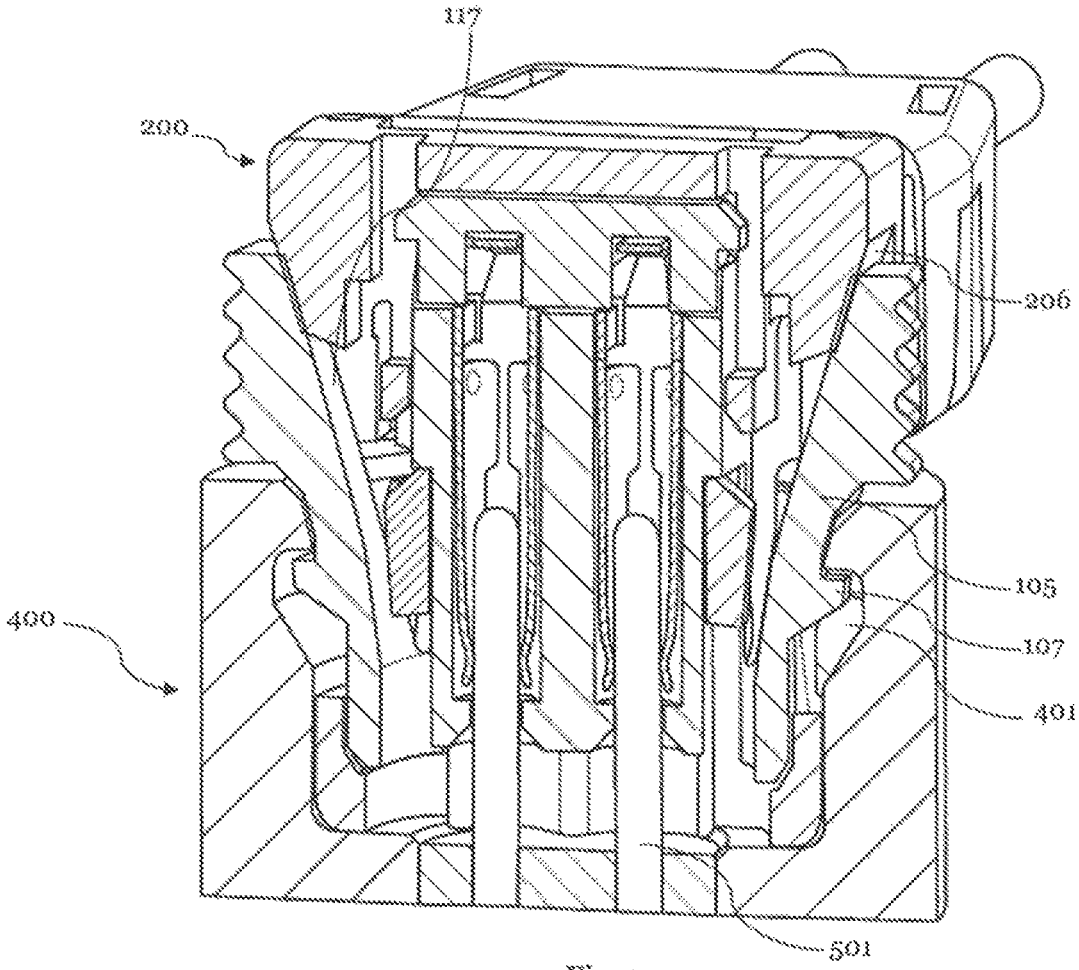
FIG. 9 shows the cross-sectional view of FIG. 8 whereby the secondary locking device is placed in the closed position.

FIG. 9 shows the secondary locking device 200 placed in the closed position in which locking surfaces 206 are moved behind corresponding surfaces of the reversed locking arms 105, thereby blocking the reversed locking arms 105 in locking engagement with the socket 400. In order to release the locking protrusions 107 out of the locking groove 401, i.e. to bend the reversed locking arms 105 inwardly, an operator first has to remove the secondary locking device from its closed position.

Figure 10:
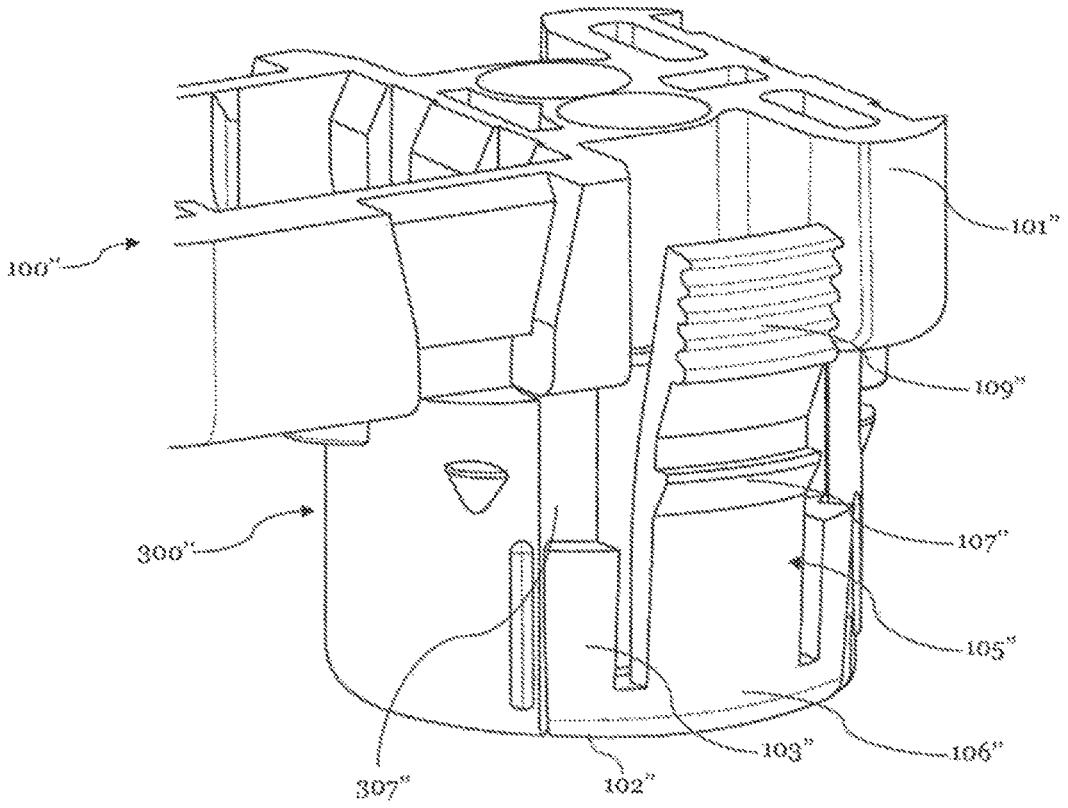
FIG. 10 shows a different embodiment of an electrical connector, connected to a different embodiment of an airbag squib retainer.

FIG. 10 shows a further embodiment of an electrical connector 100" connected to a further embodiment of an airbag squib retainer 300". As one can see, the electrical connector 100" is provided with a connector housing 101" and a reversed locking arm 105" formed as an integral part of a connection tube 103". As can be taken from FIG. 10, the cutout 307" is formed along the entire length of airbag squib retainer 300" such that the connection tube 103" is not provided with a base ring as in the case of the embodiment shown in FIG. 1.

Figure 11:
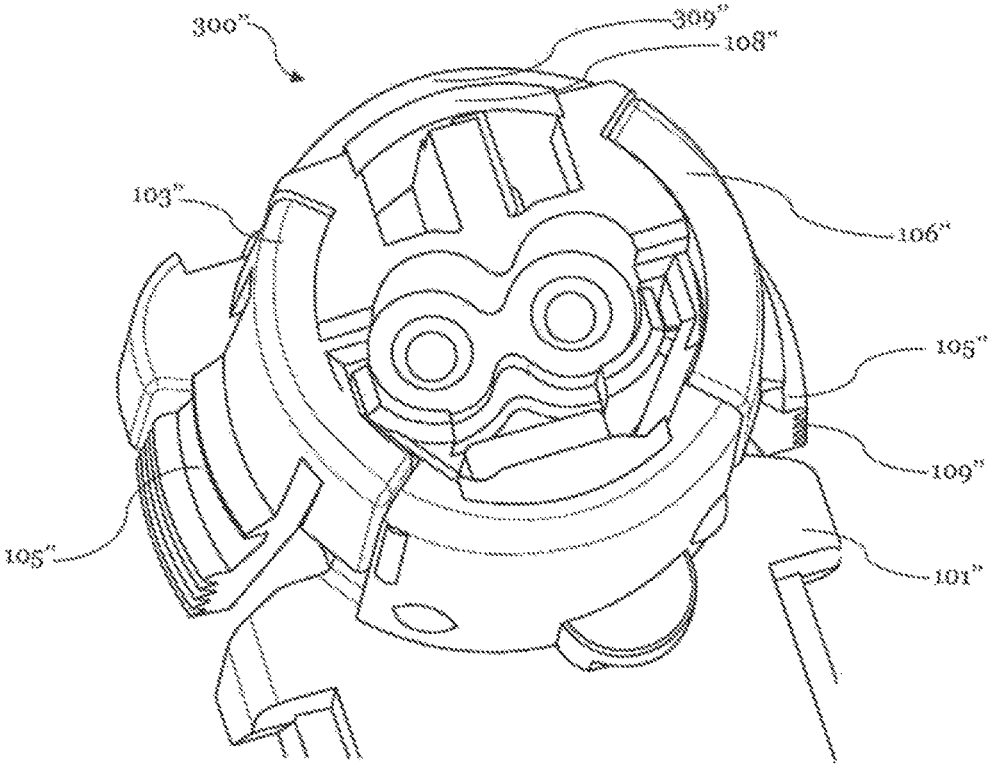
FIG. 11 shows the electrical connector and the airbag squib retainer of FIG. 10 from a different perspective.

FIG. 11 shows the electrical connector 100" and the airbag squib retainer 300" of FIG. 10 from a different perspective. As can be derived from FIG. 11, the electrical connector 100" is provided with two locking arms 105" each on one side of the connection tube 103". As may be derived from FIG. 11, to allow for the inventive construction, and in particular to provide sufficient robustness to the airbag squib retainer 300" and the connection tube 103", the airbag squib retainer 300" is provided with a thin wall portion 309" while the connection tube 103" is provided with a corresponding thin wall section 108". Thereby, it becomes possible to increase the length of the inventive reversed locking arms and still fulfill required space and dimension limitations.

Figure 12A:
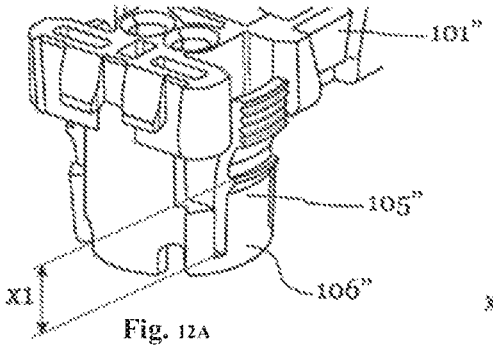
FIG. 12A shows the electrical connector of FIG. 10.
Figure 12B:
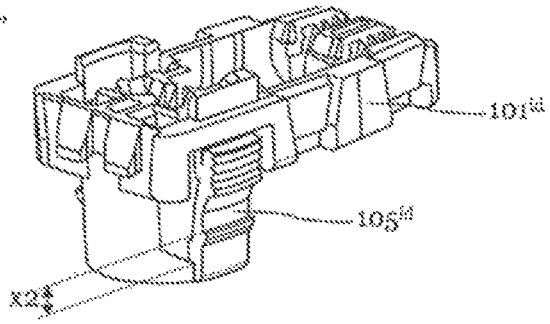
FIG. 12B shows the electrical connector of FIG. 5A.

FIGS. 12A and 12B illustrate the inventive electrical connector of FIG. 10 (FIG. 12A) compared to the intermediate development as shown in FIG. 5A above (FIG. 12B). As may be derived from FIGS. 12A and 12B, due to the inventive construction of airbag squib retainer 300" and connection tube 103" as illustrated in FIGS. 10 and 11 above, it becomes possible to construct connection tubes of longer dimension. This is indicated in FIGS. 12A and 12B by heights x1 and x2. Even though the intermediate development already provided satisfactory results, due to the larger height x1 as compared to the height x2 a free length of the reversed locking arm 105" of the inventive example is increased. Thereby, the reversed locking arm 105" could be provided with additional, suitable flexibility.

Figure 13A:
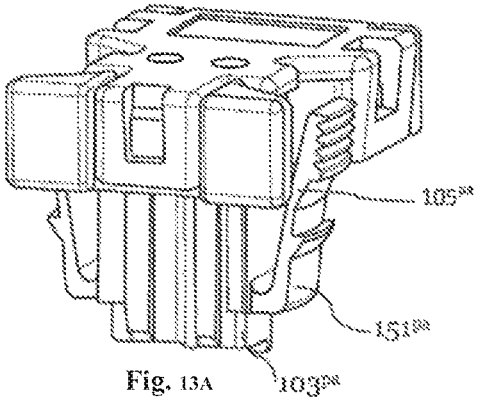
FIG. 13A shows a prior art example of an electrical connector.
Figure 13B:
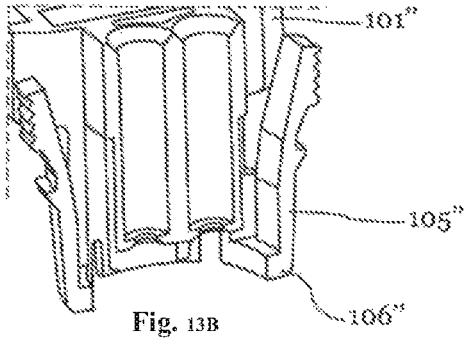
FIG. 13B shows the electrical connector of FIG. 10.

FIG. 13 illustrates typical prior art reversed locking arms (FIG. 13A) as compared to the inventive locking arms (FIG. 13B). The cut-out shown in FIG. 13B corresponds to the embodiment described in the context of FIG. 11 above. As can be taken from FIG. 13A, in order to provide the prior art reversed locking arms $\mathbf{105}^{pa}$ with the required flexibility, the same are mounted to rectangular step portions $\mathbf{151}^{pa}$ which are provided on a connection nose $\mathbf{103}^{pa}$. In contrast, as compared to this rectangular step portions, the reversed locking arms 105" according to the present invention are provided with an intrinsic advantageous flexibility due to their mounting to the inventive flexible deformable element 106". Thereby, protruding elements such as the shown rectangular step portions can be avoided, which can lead to difficulties upon assembly.

We claim:

1. An electrical connector configured to mate with a corresponding socket, comprising:

a connector housing defining a connection tube having a base ring at an insertion end of the connection tube;

a flexible deformable element formed as an integral part of the base ring; and a reversed locking arm configured to lock the electrical connector to the corresponding socket, wherein the reversed locking arm extends from the flexible deformable element in a direction essentially opposite to an insertion direction of the electrical connector into the corresponding socket, wherein the reversed locking arm defines a locking protrusion which extends outwardly from the reversed locking arm, wherein the flexible deformable element deforms due to a torsional movement essentially around a circumferential line of the base ring during insertion of the electrical connector into the corresponding socket, thereby enabling deflection of the reversed locking arm.

2. The electrical connector according claim 1, wherein the base ring deforms such that the flexible deformable element is moved inwardly towards the center of the connection tube upon insertion of the electrical connector into the corresponding socket.

3. The electrical connector according claim 1, wherein the flexible deformable element is subject to a total deformation of at least 0.01 millimeters upon insertion of the electrical connector into the corresponding socket.

4. The electrical connector according claim 1, wherein the reversed locking arm is integrally formed with the connection tube.

5. The electrical connector according claim 1, wherein the reversed locking arm is formed of a nonconductive material.

6. The electrical connector according claim 1, wherein the reversed locking arm has an essentially trapezoidal cross-section which is nonsymmetrical that is configured to enable a self-locking function of the electrical connector.

7. The electrical connector according claim 1, wherein the reversed locking arm is configured to lock the electrical connector directly to the corresponding socket.

8. The electrical connector according claim 1, wherein the electrical connector does not comprise a rectangular step portion onto which the reversed locking arm is mounted.

9. The electrical connector according claim 1, wherein the connector housing is formed from an injection molded plastic material.

10. The electrical connector according claim 1, wherein the connector housing is formed from a polyamide material containing glass fibers.

11. The electrical connector according claim 1, wherein the connector housing includes a ferrite choke configured to reduce electromagnetic inference.

12. An electrical connector system, comprising:

the electrical connector according claim 1; and an airbag squib retainer inserted into the corresponding socket and configured to receive the electrical connector, wherein the airbag squib retainer is provided with a locking tongue to lock the airbag squib retainer to the corresponding socket.

13. The electrical connector system according claim 12, wherein the airbag squib retainer has an essentially cylindrical shape and is provided with an essentially cylindrical base portion that has a cutout, wherein an overall height of the airbag squib retainer and a height of the cutout are dimensioned to facilitate said deflection of the reversed locking arm when the electrical connector is mated with the corresponding socket, and wherein a ratio of the overall height of the airbag squib retainer to the height of the cutout is less than 3.

14. The electrical connector system according claim 13, wherein the ratio of the overall height of the airbag squib retainer to the height of the cutout equals 1 and wherein the cutout is cut along an entire height of the airbag squib retainer.

15. The electrical connector system according claim 14, further comprising a secondary locking device attached to the connector housing that is movable between an open and a closed position, wherein the secondary locking device is provided with a locking surface configured to abut a corresponding blocking surface of the reversed locking arm to prevent an inward deflection of the reversed locking arm when the secondary locking device is placed in the closed position and wherein the secondary locking device can only be moved to the closed position when the electrical connector is inserted into the corresponding socket.

16. The electrical connector system according claim 15, wherein the secondary locking device is provided with a holding arm defining a stop projection and the connector housing is provided with a stop protrusion, whereby the stop projection engages the stop protrusion when the secondary locking device is placed in an open position, thereby preventing movement of the secondary locking device towards the closed position when the electrical connector is not mated with the corresponding socket.

17. The electrical connector system according claim 16, wherein the airbag squib retainer is provided with a release surface and the holding arm of the secondary locking device is provided with a deflection surface which is configured to engage the release surface upon mounting the electrical connector to the airbag squib retainer, thereby causing deflection of the holding arm to release engagement between the stop projection and the stop protrusion.

* * * * *